United States Patent [19]

Arnoux et al.

[11] 4,420,918

[45] Dec. 20, 1983

[54] STAKE NOTABLY FOR MEASURING THE ELECTRICAL RESISTANCES OF GROUND CONNECTIONS

[75] Inventors: Daniel Arnoux, St Germain en Laye; André Leconte, Le Vezinet; Claude Genter, Paris; Bernard Michel, Conflans St Honorine, all of France

[73] Assignee: Société en Commandite par actions dite: Chauvin Arnoux, Paris, France

[21] Appl. No.: 312,892

[22] Filed: Oct. 19, 1981

[30] Foreign Application Priority Data

Oct. 24, 1980 [FR] France ..... 80 22782

[51] Int. Cl.[3] ..... E02D 5/74

[52] U.S. Cl. ..... 52/157; 52/155; 411/411; 411/453

[58] Field of Search ..... 52/155, 156, 157, 162, 52/165, 705; 411/453, 411; 248/156, 545, 85, 86, 87, 88, 530, 532, 533

[56] References Cited

U.S. PATENT DOCUMENTS

| | | | |
|---|---|---|---|
| 810,807 | 9/1905 | Pitcher | 52/157 |
| 1,562,343 | 11/1925 | La Bore | 52/165 |
| 2,901,789 | 9/1959 | Frank | 52/157 |
| 3,688,454 | 9/1972 | Wolfcarius | 52/705 |

FOREIGN PATENT DOCUMENTS

| | | | |
|---|---|---|---|
| 202331 | 3/1959 | Austria | 52/157 |
| 565678 | 3/1958 | Belgium | 52/157 |
| 1504025 | 12/1967 | France | 52/157 |
| 273294 | of 1933 | Italy | 157/ |
| 869531 | 5/1961 | United Kingdom | 52/157 |

*Primary Examiner*—Alfred C. Perham
*Assistant Examiner*—Mark J. Sofia

[57] ABSTRACT

A stake is provided in the form of a smooth cylindrical metal rod which has a point at its lower end and to which is welded a screw thread formed by a helical spring having a polygonal cross-section, preferably a square section, which is welded to the rod at a limited number of spaced-apart points, at least a part of the spring being thus free to move with respect to the rod. Preferably, only the lower end of the spring is welded to the rod. The stake is more especially, but not exclusively, usable for measuring the electrical resistances of ground connections.

7 Claims, 1 Drawing Figure

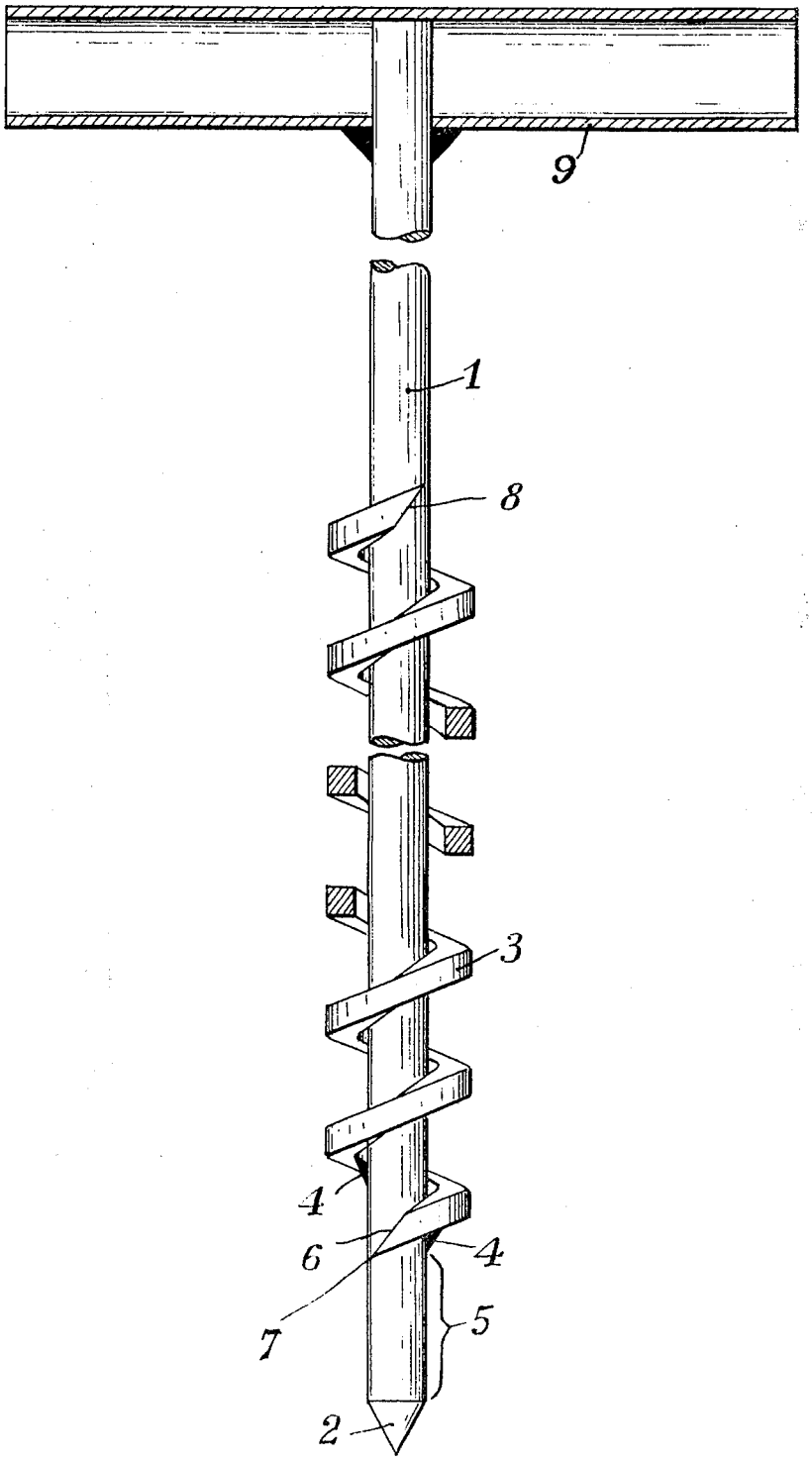
9
1
8
3
4
6
4
7
5
2

STAKE NOTABLY FOR MEASURING THE ELECTRICAL RESISTANCES OF GROUND CONNECTIONS

BACKGROUND OF THE INVENTION

The present invention relates to a stake usable more especially, but not exclusively, for measuring the electric resistances of ground connections, of the type comprising a smooth cylindrical metal rod, which has a point at its lower end and to which is welded a helical screw thread.

Numerous stakes made from metal or another material are already known (see for example French Pat. Nos. 815 246 and 1 218 876, Canadian Pat. No. 919 378, Swiss Pat. No. 390 509, English Pat. No. 299,516 and German Pat. No. 2 105 388).

For measuring the electric resistances of ground connections, it is necessary to provide temporarily two auxiliairy ground connections, one serving for injecting the measuring current and the other for taking the reference potential. These ground connections are generally provided in the form of stakes which, in order to present an acceptable electric resistance, must be driven into the ground to a depth of the order of 40 to 50 cm. To carry out this operation in the different kinds of soils likely to be encountered, two types of stakes are at present used. The stakes of the first type are formed by a rod having a head at one end, the other end being pointed so as to facilitate penetration thereof into the ground. The stakes of this type have the disadvantage of requiring a hammer to drive them into the ground and it is difficult to remove them subsequently from the ground.

The stakes of the second type are in the form of an auger having at its upper end a transverse handle. They may be driven manually into the ground by associating, by means of said transverse handle, a rotational movement with the vertical driving pressure properly speaking. The stakes of this second type allow the prescribed driving depth to be attained in a great variety of soils, without the need for a hammer and, moreover, they may be easily removed subsequently. However, the stakes of this second type are generally formed by a forging, founding or welding operation which, on the one hand, is relatively expensive and, on the other hand, does not readily provide the optimum shape desirable. In particular, when a helical sheet-metal flange is welded to the rod, it must be welded over the whole of its length.

SUMMARY OF THE INVENTION

The object of the present invention is to provide a stake which may be easily driven in and subsequently removed from the ground, without the need for an accessory tool, and which is simple and inexpensive to manufacture.

To this end, the invention provides a stake characterized in that its screw thread is formed by a helical spring with polygonal cross-section, which is welded to the rod at a limited number of spaced points, at least a part of the spring being free to move with respect to the rod.

According to a preferred embodiment of the present invention, only the lower end of the spring is welded to the rod, the remaining part of the spring thus retaining its resilience and being free to move with respect to the rod. Preferably, the stake comprises a smooth cylindrical part between the point of the rod and the lower end of the spring. This smooth part allows the first penetration of the stake into the ground to be guided. During driving in of the stake by screwing, the resilience of the helical spring forming the screw thread and the freedom of movement of at least a part of the spring with respect to the rod facilitate the clearing of possible obstacles such as stones. The perfect concentricity and the perfect regularity of the added helical spring facilitate the penetration of the stake into the ground.

DESCRIPTION OF THE DRAWING

The single FIGURE of the accompanying drawing shows, by way of example, one embodiment of the stake of the present invention.

DESCRIPTION OF THE PREFERRED EMBODIMENT

The stake shown in the drawing comprises a smooth cylindrical rod 1 having a point 2 at its lower end. A helical spring 3 surrounds rod 1 over a part of its length. The lower part of spring 3 is fixed to rod 1 by welding as is shown at 4 in the drawing. Preferably, the lower end of spring 3 is welded to rod 1 at a distance from point 2 so as to provide a smooth cylindrical part 5 of a few centimeters in length for guiding the first penetration of the stake into the ground. Preferably, the lower end of spring 3 is chamfered or bevelled as shown at 6 in the FIGURE, so as to form a cutting edge 7 which facilitates the first penetration into the soil of the screw thread formed by spring 3. Similarly, the upper end of the spring may be chamfered as shown at 8 to facilitate extraction of the picket by unscrewing.

Rod 1 and spring 3 may be for example made from steel, preferably tempered steel so as to confer on the picket good resistance to wear and to maintain on the screw thread sharp edges favorable to its use. Spring 3 has preferably a square cross-section. Such springs are readily available commercially. Tests effected with stakes provided with a square-section helical spring made from tempered steel have given good results from the electrical point of view, from the point of view of the ease with which they can be driven into the ground and extracted from the ground, and from the point of view of wear. However, spring 3 may also have a triangular section or a trapezoidal section.

Rod 1 is provided at its upper end with a transverse handle 9, which may for example be formed by a short tube welded to the upper end of rod 1. Instead of being permanently fixed to rod 1, transverse handle 9 may be removably fixed to rod 1 in any appropriate way or it may be mounted for pivoting about a transverse axis on the upper end of rod 1 so as to be able to be brought from the transverse working position to a longitudinal position, along rod 1, for transport or storing thereof.

It will moreover be readily understood that the embodiment of the stake which has just been described above has been given by way of example, and that many modifications may be readily made by a man skilled in the art without departing from the scope of the present invention. Thus, more especially, spring 3 may be welded at both ends or at several points spaced apart along its length to rod 1. Furthermore, although in the above description it has been more particularly considered using the stake of the invention for measuring the electric resistances of ground connections, it may be advantageously used in numerous other fields, for example as a post for animals, as a tent peg for camping, as a mooring post for boats, as a lawn sunshade support (by constructing rod 1 with a hollow end-piece), as a support post for a temporary road signaling panel.

What is claimed is:

1. In a ground stake comprising a smooth cylindrical metal rod, which has a point at its lower end and to which is welded a helical screw thread, the improvement consisting in that the screw thread is formed by a helical spring made of a wire having a polygonal cross-section, which surrounds the rod at a short radial distance therefrom and which is welded to the rod at a limited number of points, so that a substantial part of the spring is free to move resiliently with respect to the rod while being guided thereby.

2. The stake as claimed in claim 1, wherein the lower end of the spring is welded to the rod, the remaining part of the spring being free to move with respect to the rod.

3. The stake as claimed in claim 1, wherein a smooth cylindrical part is provided between the point of the rod and the lower end of the spring.

4. The stake as claimed in claim 1, wherein the lower end of the spring is chamfered.

5. The stake as claimed in claim 1, wherein the spring wire has a square section.

6. The stake as claimed in claim 1, wherein the rod and the spring are made from tempered steel.

7. In a stake comprising a smooth cylindrical metal rod, which has a point at its lower end and to which is welded a helical screw thread, the improvement consisting in that (a) the screw thread is formed by a helical spring with polygonal cross-section, which is welded to the rod at a limited number of spaced-apart points at least a part of the spring being free to move with respect to the rod, and (b) a smooth cylindrical part is provided between the point of the rod and the lower end of the spring.

* * * * *